US005621996A

United States Patent [19]

Mowl, Jr.

[11] Patent Number: 5,621,996

[45] Date of Patent: Apr. 22, 1997

[54] COMBINATION SECURITY AND DISPLAY DEVICE FOR FIREARMS

[75] Inventor: George M. Mowl, Jr., Cincinnati, Ohio

[73] Assignee: Pride Cast Metals, Inc., Cincinnati, Ohio

[21] Appl. No.: 478,953

[22] Filed: Jun. 7, 1995

[51] Int. Cl.[6] ..... F41A 17/00

[52] U.S. Cl. ..... 42/70.07; 42/70.08; 42/70.11; 211/64

[58] Field of Search ..... 42/70.07, 70.08, 42/70.11; 211/64

[56] References Cited

U.S. PATENT DOCUMENTS

| | | | |
|---|---|---|---|
| 1,513,267 | 10/1924 | Parks | 211/64 |
| 3,307,755 | 3/1967 | Lentz | 42/70.07 |
| 3,419,728 | 12/1968 | Wilson | 224/1 |
| 3,468,427 | 9/1969 | Leslie | 312/204 |
| 3,566,526 | 3/1971 | La Violette | 211/64 |
| 4,155,608 | 5/1979 | Orlewicz | 42/70.07 |
| 4,197,951 | 4/1980 | Shassere | 211/4 |
| 4,299,045 | 11/1981 | Cervantes | 211/64 |
| 4,461,385 | 7/1984 | Clouser | 211/4 |
| 4,596,334 | 6/1986 | Daulton | 211/64 |
| 4,936,038 | 6/1990 | Johnson et al. | 42/106 |
| 5,138,786 | 8/1992 | Fischer | 42/70.11 |
| 5,271,174 | 12/1993 | Bentley | 42/70.11 |
| 5,309,661 | 5/1994 | Fuller et al. | 42/70.07 |
| 5,487,234 | 1/1996 | Dragon | 42/70.07 |

*Primary Examiner*—J. Woodrow Eldred
*Attorney, Agent, or Firm*—Dinsmore & Shohl, L.L.P.

[57] ABSTRACT

A mountable security and display device for storing a firearm uses a pair of complementary casings that can be locked in a closed position whereby the casings substantially surround and prevent access to the operational portions of a firearm. To facilitate quick access to the firearm, the casings can be remotely unlocked. Once unlocked, the casings automatically open to an opened position whereby the casings hold the firearm and provide substantially unimpeded access thereto. The apparatus can be arranged to store the firearm in a loaded condition, and can be configured to store ammunition separately.

21 Claims, 6 Drawing Sheets

COMBINATION SECURITY AND DISPLAY DEVICE FOR FIREARMS

TECHNICAL FIELD

The present invention relates to the field of security and display devices for firearms, and more specifically to a security device for mounting, locking, and providing quick access to a firearm.

BACKGROUND OF THE INVENTION

Many people own firearms for protection, sport or both. Storage of such firearms has lead to three seemingly conflicting considerations: security, quick access, and attractive display. Security of firearms is critical to prevent unauthorized access to the firearm. Firearms are often kept in the home or other locations where access must be limited due to obvious concerns, such as access by children or others unfamiliar with firearms. Security is also critical to prevent a possible intruder from accessing the firearm and using it against the owner. In addition, many firearms are expensive, and while their owners enjoy displaying them, they want to minimize the risk of theft or misuse. While security is critical, quick access is essential.

For example, in an emergency situation where time is often of the essence, the owner needs quick access to the firearm to protect the home, self, or family. At the same time, attractive display of the firearm can be desirable for numerous reasons. For instance, displaying a firearm can have a deterrent effect on prospective intruders thus reducing the possibility of a dangerous confrontation. Apart from protection and deterrence, many owners simply enjoy displaying their firearms. As each of these three considerations are important, many firearm owners would appreciate the convenience and peace of mind of a security and display device that minimizes the risk of unauthorized access while maximizing display characteristics and unimpeded ready access when needed.

Security and display devices have long been used to store firearms, but none have provided a device that does not critically limit one or more of the three considerations of security, quick access, and attractive display. For example, many owners store their firearms in a locked box or chest. While such a device can provide excellent security, the considerations of quick access and attractive display are sacrificed. As another example, some owners store their firearms in a glass enclosed cabinet that is lockable using a combination of nooses, bolts, hooks, straps and magnets to fasten the firearm against the cabinet wall. For example, see U.S. Pat. No. 4,936,038. Such a device addresses the consideration of attractive display, but security is compromised as glass can be easily broken. Also, quick access is critically impeded as the owner must go through the steps of unlocking the lock, opening cabinet, releasing the firearm, and then retrieving the firearm.

Security and display devices are also used in vehicles, such as armored cars or police cruisers. For example, some police cruisers have firearms secured onto the dashboards using locking brackets, which can be unlocked if a release button is pressed. Typically, such a button will be hidden within the vehicle. Even if the button is hidden, security is jeopardized because anyone can activate the button. For instance, on occasion police officers must quickly leave the cruiser with the doors unlocked or outright opened. At that point, a criminal could conceivably enter the cruiser, search for the button, and access the firearm. Furthermore, quick access is jeopardized as the officer must physically activate the hidden button before he or she can retrieve the firearm.

The lock box disclosed by Fischer in U.S. Pat. No. 5,138,786 attempted to incorporate the three considerations of security, quick access, and attractive display in the storage of rifles and shotguns. However, the Fischer lock box has undesirable limitations. One such limitation is that before access can be obtained to the firearm, the user must manually enter a combination and manually open the lock. These steps will be hindered by a number of factors like a poor lighting in a darkened room or the hurried nervousness that a user will inevitably experience in an emergency situation. In addition, the lock box fails to provide its own means for holding the firearm when the box is open, thus making access clumsy as the user must concentrate on both unlocking the box and holding the firearm. Another limitation of the Fischer lock box is in the area of security. Specifically, it is conceivable that someone could access the inside of the lock box with a probe, such as a hanger or stick, and manipulate the trigger or hammer, possibly causing an unintentional discharge. As an accidental discharge is possible, a prudent firearm owner using the lock box might purposefully leave the firearm unchambered or unloaded, thus adding yet another step in fully accessing the firearm for use.

The mounting and locking mechanism for handguns disclosed by Cervantes in U.S. Pat. No. 4,299,045 shares many of the problems with the other prior art. For example, an owner must go through the steps of manually entering a combination, manually opening the lock, and then manually navigating the handgun around hooks and posts, to retrieve the firearm. This mechanism also compromises security because operational portions of the firearm are relatively accessible, such as the cylinder in a revolver or the magazine release in a semi-automatic. As such, unauthorized access to the ammunition remains a real possibility, which can potentially result in an unintentional discharge. Because ammunition is accessible, a prudent owner will likely leave the firearm unloaded making if useless in an emergency situation.

Thus, there is a need for a storage device that securely locks the firearm, permits quick access to the firearm in an emergency, and attractively displays the firearm.

SUMMARY OF THE INVENTION

Accordingly, it is an object of this invention to provide a combination security and display device for firearms which addresses the shortcomings and problems of previously available mechanisms.

It is also an object of the invention to provide a mountable storage device to secure and display firearms, providing the owner quick access to the firearm for use.

Another object of the invention is to provide a mountable storage device to secure and display firearms, that provides the owner quick access to the firearm for use, whereby the device will retain the firearm for unimpeded access when the device is in the open position.

A further object of the invention is to provide a mountable storage device to secure and display different types and sizes firearms, that provides the owner quick access to the firearm for use, whereby the device will retain the firearm for unimpeded access when the device is in the open position.

Still a further object of the invention is to provide a mountable storage device to selectively secure and display different types and sizes of firearms, that provides the owner quick access to the firearm for use, whereby the device will retain the firearm for unimpeded access when the device is in the open position, and which can also secure ammunition separately from the firearm.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention disclosed herein, an improved combination security and display device for firearms is provided for securing firearms in a manner that allows for its attractive display, while permitting quick and relatively unimpeded access to the firearm in an emergency.

The improved combination security and display device comprises a pair of complementary casings having a base casing and a cover casing. The base casing is adapted for mounting onto a structure and includes a means for receiving and holding the firearm. The cover casing is adapted for interfacing with the base casing and at least partially covering the firearm. The device additionally comprises a means for connecting the cover casing to the base casing such that the casings have a predetermined open position providing substantially unimpeded access to the firearm, and a predetermined closed position whereby the casings prevent access to the operational portions of the firearm. The device further comprises a locking system for locking the casings in the closed position to prevent the unauthorized opening of the casings to the open position, and a means for automatically opening the casings to the open position when the locking system is unlocked.

Preferably, the base casing has an outwardly and upwardly tapered front portion for receiving and holding the firearm, and the means for connecting the cover casing to the base casing includes a hinge. Additionally, the device preferably includes a separate ammunition receptacle in at least one of the casings, and at least one stop which extends from at least one of the casings, which is adapted to be aligned closely behind one or more of the operational portions of the firearm for preventing unauthorized activation thereof. A preferred locking system comprises an electrically actuated lock, a means for remotely unlocking the electrically actuated lock, and a manual lock for overriding the electrically actuated lock. The preferred means for automatically opening the casings is a biasing element that moves the casings to the open position.

Still other objects and aspects of the present invention will become apparent to those skilled in the art from the following description of a preferred embodiment, which is simply by way of illustration one of the best modes contemplated for carrying our the invention. As will be realized, the invention is capable of other different obvious aspects all without departing from the invention. Accordingly, the drawings and descriptions are illustrative in nature and not restrictive.

BRIEF DESCRIPTION OF THE DRAWINGS

The accompanying drawings, incorporated in and forming a part of the specification, illustrate several aspects of the present invention, and together with the description, serve to explain the principles of the invention. In the drawings.

Reference will now be made in detail to the present preferred embodiments of the invention, examples of which are illustrated in the accompanying drawings, which like numerals indicate the same elements throughout the views.

DETAILED DESCRIPTION OF THE INVENTION

Figure 1:
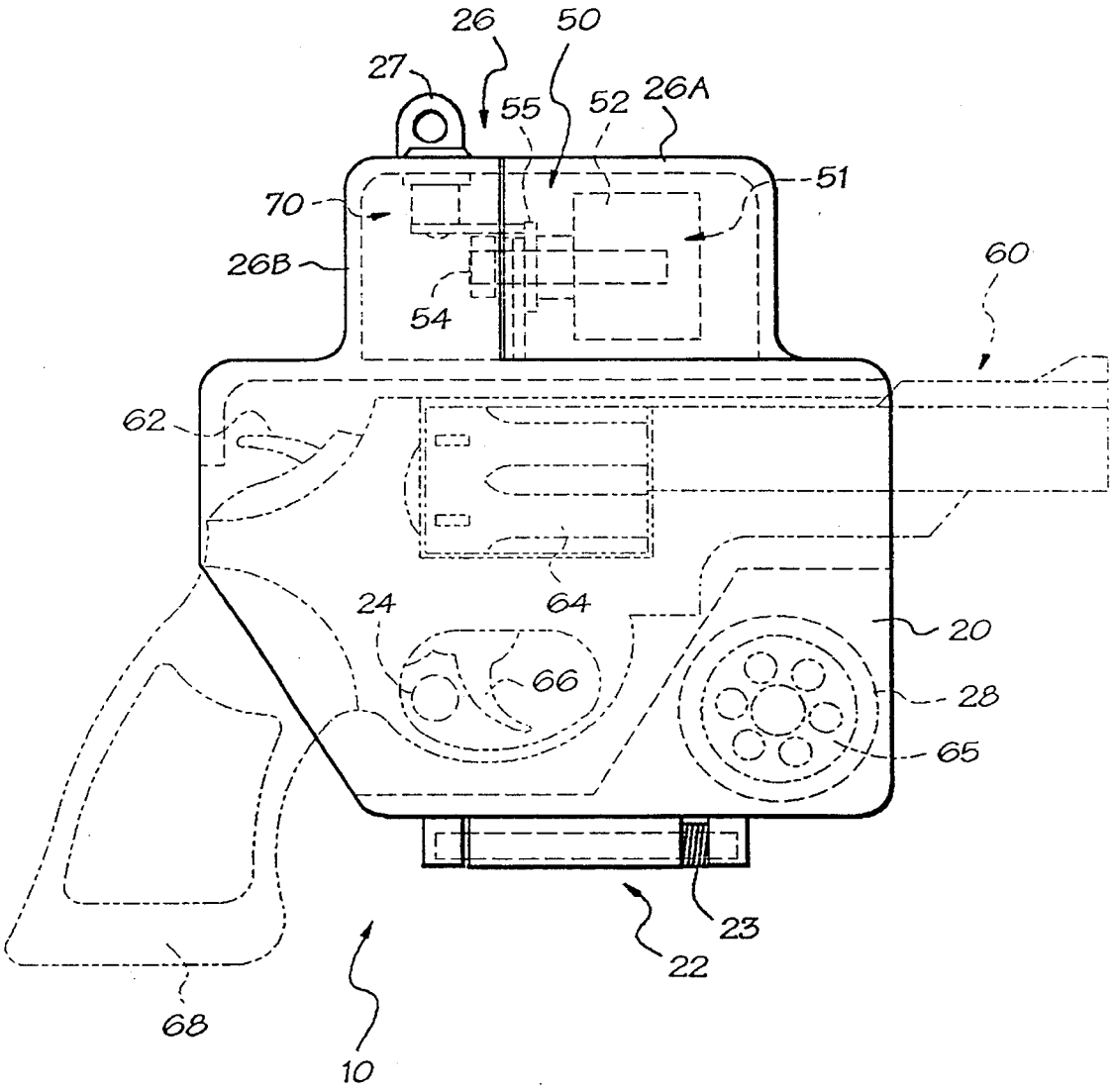
FIG. 1 illustrates a front view of a security and display device made in accordance with the present invention, shown in the closed position, containing an exemplary revolver type firearm illustrated in phantom for orientation.

As shown in FIG. 1, the improved combination security and display device (10) substantially encloses the operational portions of a firearm (60) such that those portions cannot be accessed for any significant movement. Hereinafter, the term "operational portions" of the firearm will be used to refer to the portions of the firearm that, when accessed, could release or expose ammunition or cause the firearm (60) to discharge. Examples of operational portions include the trigger (66), hammer (62), cylinder (64), and clip release button (not shown) for semi-automatic type firearms. While some access of operational portions may be possible in certain applications, such access will be limited to ensure that the firearm (60) cannot be discharged and ammunition cannot be removed or otherwise accessed when the device (10) is closed and locked.

Figure 2:
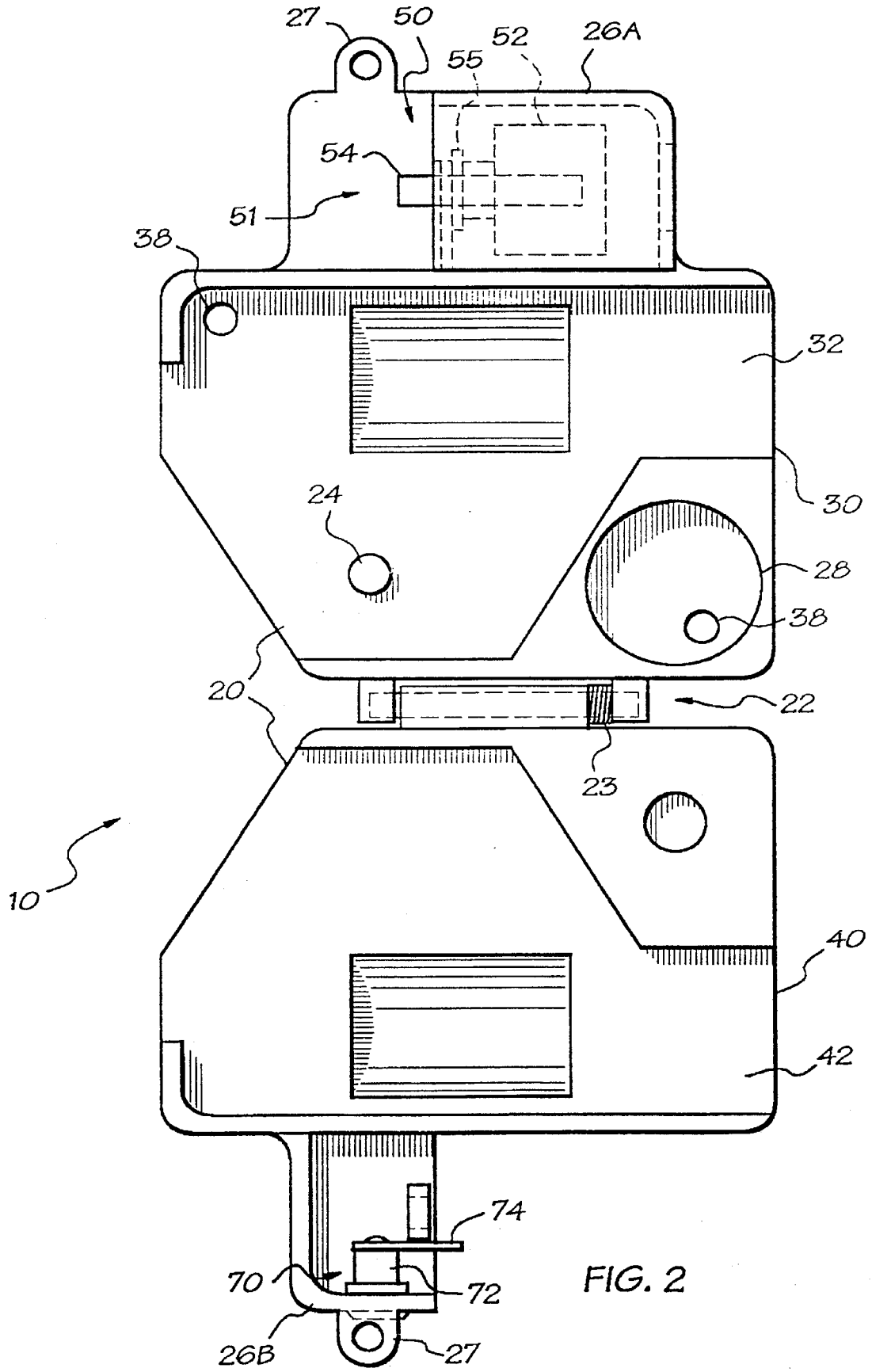
FIG. 2 illustrates a front view of the device of FIG. 1, shown in the open position, without a firearm to illustrate internal details of the device.

As best seen in FIG. 2, the device (10) comprises a pair of complementary casings (20) including a base casing (30) and a cover casing (40). The two casings (30, 40) are connected such that the device (10) has predetermined open and closed positions. In the open position the firearm (60) is readily accessible in a manner that is substantially unimpeded. Hereinafter, the term "substantially unimpeded" will connote that the firearm (60) can be directly removed without significant interference, hindrance, or encumbrance from mounting structures, straps, hooks, or other binding elements which have to be manually released, manipulated or manipulated around. While the device (10) is in its open position, it is intended that the firearm (60) can be quickly and easily removed for direct use. In the closed position the casings prevent unauthorized physical access to the operational portions of the firearm. Preferably, the casings (20) are constructed from a material strong enough to resist a violent attempt to open the device (10) or otherwise access the firearm (60). Appropriate materials could include any high strength material, such as ferrous alloys, non-ferrous alloys (e.g. aluminum alloy A-356-T6), or any other non-metallic material (e.g. lexan). The casings (20) can be coated with a material (e.g. urethane, epoxy, paint, etc.) for numerous reasons, such as for protecting the casings, preventing abrasion or degradation of the firearm, and ornamenting the device (10).

Figure 5:
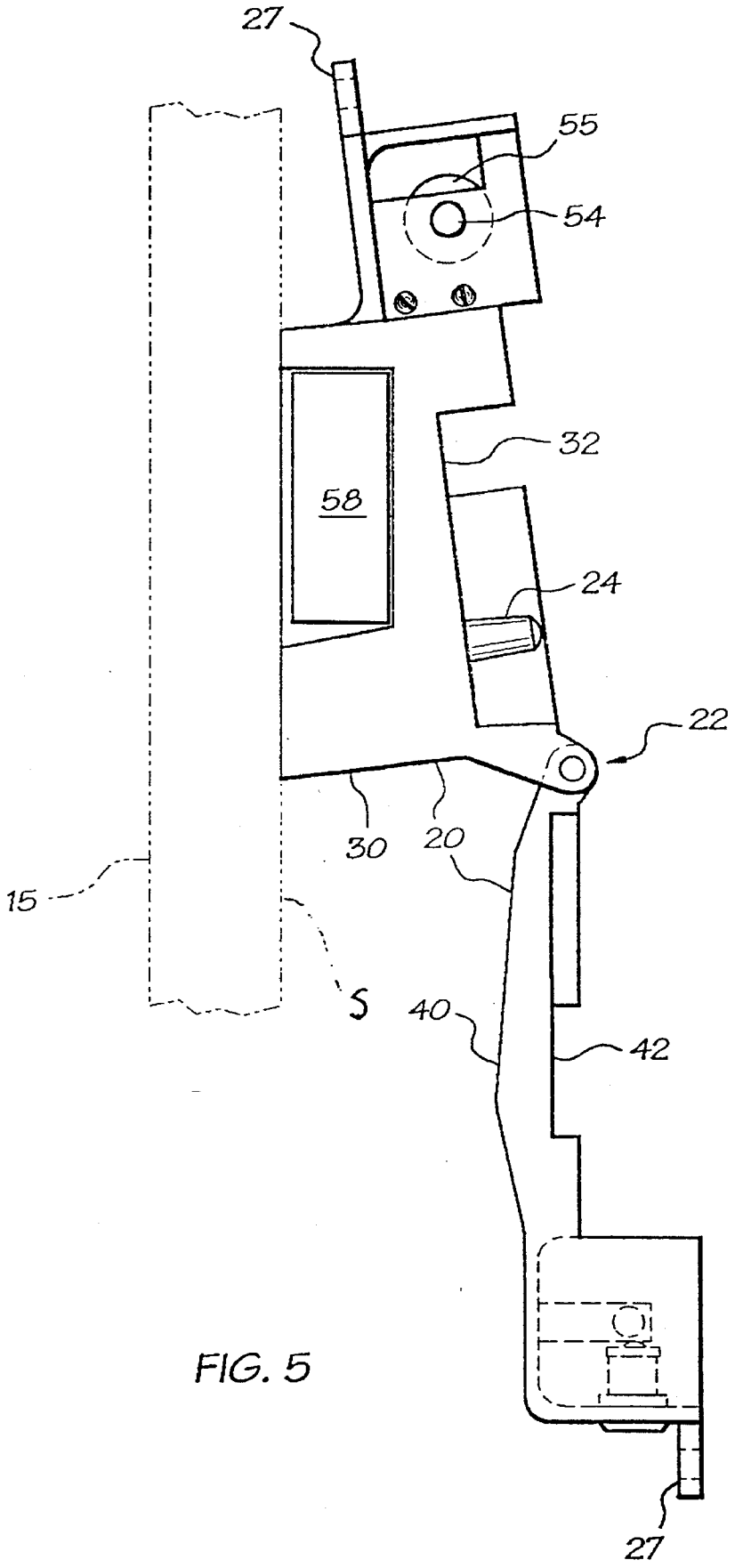
FIG. 5 is a right side view of the device of FIG. 2, mounted on a wall.

As shown in FIGS. 2 and 5, the base casing (30) has an interior surface (32) adapted for receiving and holding the firearm (60) when the device (10) is in the open position. The surface (32) employs various recesses, curves, and depressions that generally conform to the firearm (60) so that such firearm will fit nicely into the device (10). The surface (32) is preferably tapered upwardly and outwardly (e.g. from wall surface S) to provide a means for receiving and holding the firearm (60) when the device is in the open position. As will be understood, this upward and outward taper is also helpful in enabling the device to receive and hold a firearm without requiring additional clamps, straps or other supports which may interfere with accessing the firearm without hindrance. Such a surface (32) might be formed integrally with one or more of the casings (20), or might preferably be provided as a removable insert (34) which can be selectively replaced to match a particular firearm. The insert itself may be provided as a single piece, or as multiple pieces as desired.

Such insert (34) can provide an alternative or complementary means for receiving and holding the firearm (60). Such means are achieved by using an insert or combination of inserts for providing a snug fit for the firearm (60). Preferably, at least portions of these inserts are constructed from a resilient material (e.g. foam, rubber, plastic, etc.), which can be permanently or removably located within the base casing (30). A modular system of predetermined sizes and shapes of inserts can be used to selectively accommodate and snugly receive a variety of firearm types and models. Alternatively, the inserts can be molded (either on-site or in a pre-formed manner) to fit around a particular firearm (60). For example, the firearm (60) might be partially surrounded by a bladder (not shown) either pre-filled or filled in-situ with liquid foam. Once the foam sets and solidifies, the resulting insert will exactly fit that particular firearm. It is contemplated that use of inserts to provide either a conforming travel mounting surface and/or a snug press-fit receptacle for a firearm will enable a single device (10) to be selectively utilized for any of a variety of firearms, simply by exchanging one or more such inserts. The inserts can be mounted in one or more of the casings (20) by any convenient means, such as adhesive, snap fits, mounting screws, or the like.

Notice that with either the tapered surface or snug fit means for receiving and holding the firearm (60), the owner or authorized user has substantially unimpeded access to retrieve the firearm (60). At the same time, the means for receiving and holding is sufficient to hold the firearm (60) while the device (10) is in the process of being opened or is at rest in the open position. Also notice that the handle (68) of the firearm (60) hangs substantially free from the device (10) and away from the wall (15) such that the owner or authorized user may readily grab the handle (68) without having to negotiate interfering structures, such as the device (10) and the wall (15). Depending upon the application, the device (10) may include an additional means to hold the firearm if such means does not hinder or impede access to the firearm. For instance, a Velcro strap may be added to hold the firearm if the strap easily and automatically releases once the firearm is pulled.

Although one skilled in the art can select many suitable structures for receiving and holding the firearm, the above embodiments are preferred because they hold the firearm while facilitating quick access of the firearm. Many of the other methods and structures previously available heretofore restrain the firearm using a combination of nooses, bolts, hooks, straps and magnets, which can make the firearm more difficult to remove in a hurried emergency situation.

Figure 4:
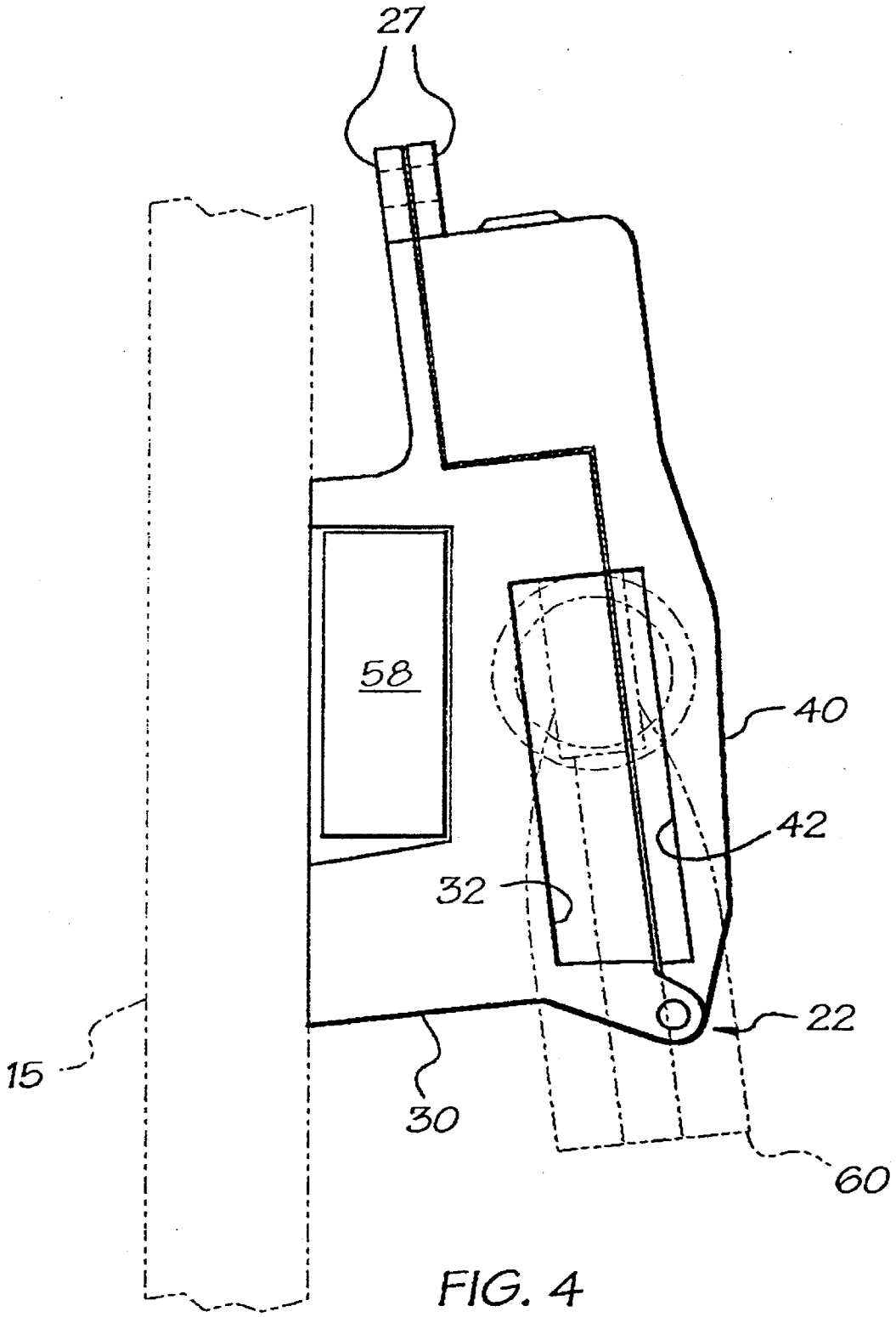
FIG. 4 is a right side view of the device of FIG. 1 mounted on a wall.
Figure 6:
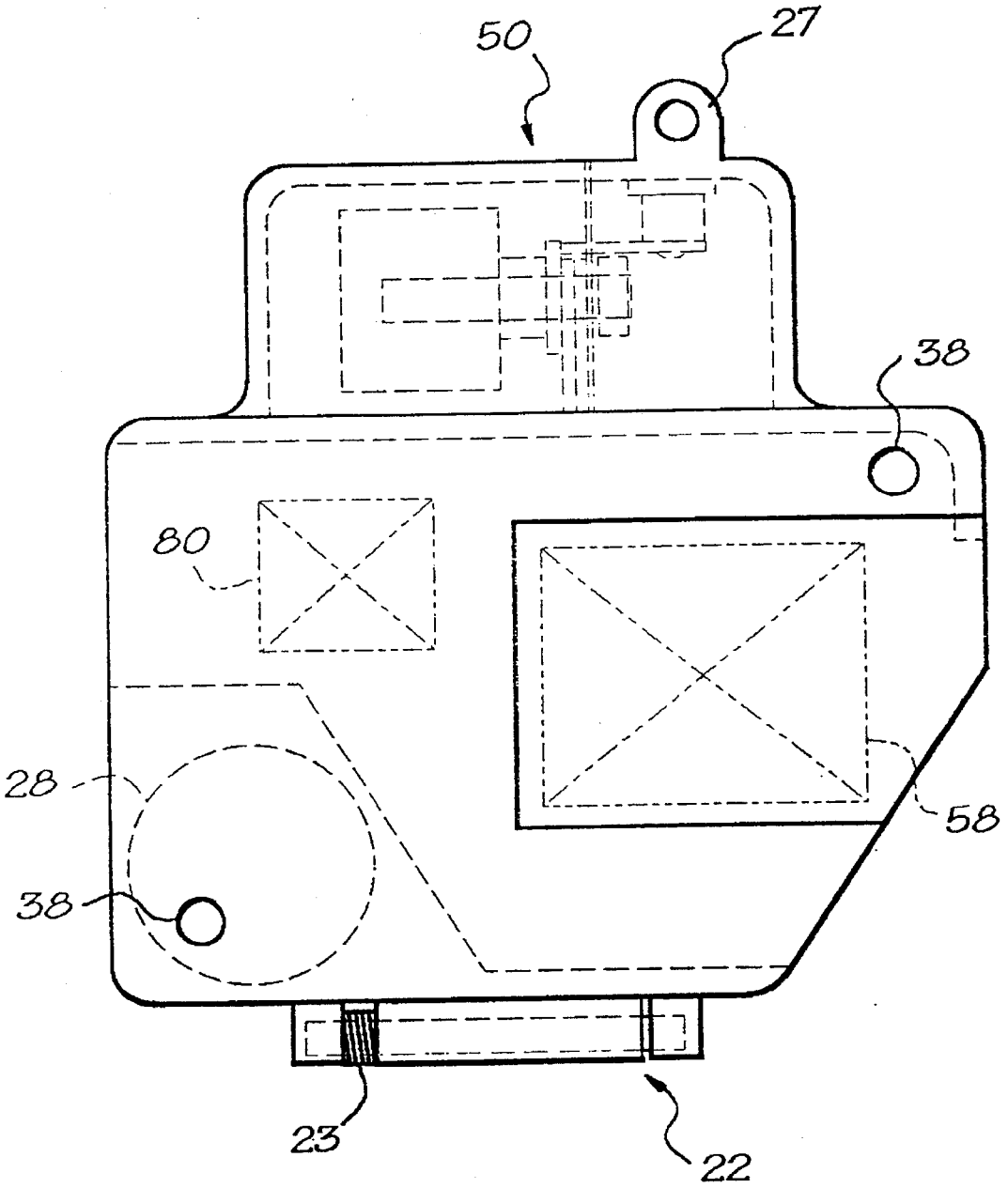
FIG. 6 is a rear view of the device of FIG. 1 illustrating the mountable features of the invention and a symbolicly depicted security system.

As illustrated in FIGS. 4 and 5, the base casing (30) is adapted for mounting on a wall (15) or similar structure (e.g. bulkhead, display case, dashboard, etc.). FIGS. 2 and 6 show mounting bores (38) for accommodating bolts or the like for mounting the device (10) on a wall or similar structure. When mounted on a wall, the device (10) can be aligned with standard wall studs so that it can be anchored directly thereto for maximum stability. Preferably, the bolts are of sufficient strength and design to minimize the potential of the device (10) being undesirably removed from the wall or similar structure.

The cover casing (40) is adapted for interfacing with the base casing (30) and at least partially coveting the firearm (60) when the device (10) is in the closed position. Like the base casing (30), the cover casing (40) has an interior surface (42) that employs recesses, curves, and depressions to accommodate the firearm (60). The interior surface (42) is tapered to complement the base casing interior surface (32). Also like the base casing (30), the cover casing (40) can include one or more inserts (44) made of an at least partially resilient material to protect the firearm and to accommodate a variety shapes and sizes of firearms.

One skilled in the art may use many means to connect the casings (30, 40), such as slide rails or a tether cord, to allow for relative movement between the predetermined open and closed positions thereof. The connection of the casings can also be detachable, where the cover casing (40) may actually be separated from base casing (30) upon opening. However, the preferred means for connecting the casings (30, 40) includes a hinge connection (22). As one skilled in the art will readily appreciate, a variety of hinge connections may be used, such as one or more door-type hinges or a pin arrangement. Preferably, the hinge connection (22) is located at the bottom of the device (10) so that when in the open position, the cover casing (40) will rotate downwardly so as not to hinder or impede access to the firearm (60).

As shown in FIGS. 4 and 5, the base casing (30) will usually be mounted to a wall (70) or other immovable structure. The cover casing (40) preferably rotates about the hinge (22) to open the device (10) to its open position. The device (10) can be designed so that the cover casing (40) opens to a predetermined open position, such as approximately 90 to 180 from vertical. If the cover casing opens to 180, it may be desirable to use a guard or cover stop (not shown) to "catch" the swinging cover casing (40) as it opens to prevent marking the wall (15) or other structure on which the device (10) is mounted. Additionally, a damper or shock absorbing device (not shown) may be used to slow the rotation of cover casing (40) to prevent it from bouncing back and possibly hindering quick access to the firearm (60). Preferably, the hinge (22) is of sufficient strength and design to resist violent attempts to open the device (10). To prevent the tampering of the hinge (22), the casings (30, 40) can further enclose all or most of the hinge (22), such as by including flanges (not shown) to overlie and prevent physical access through joints or seams between the casings.

As best seen in FIG. 1, the device preferably includes at least one stop or post (24) extending outwardly and preferably substantially perpendicular from at least one of the casings (30, 40) so as to be aligned closely behind the trigger (66), the hammer (62), or both, for preventing the discharge of the firearm when the device (10) is in the closed position.

An alternative embodiment of the invention might include a shortened stop (24) extending perpendicularly from each casing (30, 40), instead of one longer stop (24) from single casing (e.g. 30), which align when the device (10) is in the closed position.

As shown in FIGS. 1 and 2, each casing (30, 40) has a complementary locking member (26*a*, 26*b*) that forms a lock case (26). In the closed position, the lock case (26) encloses the locking system (50) and prevents unauthorized tampering of the locking system (50). Preferably, the lock case (26) includes overlapping flanges (not shown) where the locking members (26*a*, 26*b*) join to prevent access within. While in the closed position, the locking system (50) locks the casings (20) to prevent the unauthorized opening of the device (10). One skilled in the art may select many suitable types of locks for use with this device (10), such as key locks, combination locks, and numbered key pad locks. Preferably, the locking system comprises an electrically actuated lock (51).

As illustrated in FIGS. 1 and 2, an acceptable electrically actuated lock (51) can take the form of a solenoid (52) having a reciprocal plunger (54) acting as the lock dead bolt. When the solenoid (52) is at rest and without a current, it is preferred that the plunger (54) be biased to the locked position. If an electrically actuated lock (51) is used, the power source can be hardwired from the wall (15) and hidden by the base casing (30) to prevent the tampering of the power source. In addition, a battery (not shown) acting as the sole or back-up power source can be enclosed within the casings (70) or otherwise connected therein from a remote position.

The device (10) can include a manual lock (70) for complementing and overriding the electrically actuated lock (51). As shown in FIGS. 1 and 2, when the tumbler (72) is turned, the arm (74) rotates, pushes against the disk (55) connected to the plunger (54), and retracts the plunger (54) into the solenoid (52). As such, the device (10) can be unlocked without using the electrically activated lock (51). This configuration may be desirable in a power outage situation or where the controller (56, discussed below) is unavailable. The device can include two or more locking system (50) locks. For example, a lock eyelet (27) may be included on each casing (30, 40) such that in the closed position the two eyelets (27) align and allow a pad lock (not shown) to secure the device (10) in the closed position. Such a configuration may be desirable when the owner wants increased security and the need for quick access is obviated, such as when the owner leaves his home for an extended period of time.

To facilitate quick access to the firearm, the device (10) can include a means for automatically opening the casings (20) when the locking system (50) is unlocked. Preferably, such means are achieved by a biasing element moving the casings (20) to the open position when the locking system (50) is unlocked. For example, a torsional spring (23) acting on the cover casing (40) may be incorporated within the hinge connection (22). To further facilitate quick access to the firearm (60), the device (10) can include a means (e.g. controller (56) discussed below) for remotely unlocking the locking, system (50). Such a means allows the owner to unlock the device (10) from a distance as he or she approaches the device (10). Thus, when the owner reaches the device (10), he or she only has to remove the firearm (60).

The remote means can be provided in the form of an electronic hand-held controller (56) that sends an "open" signal to the device (10). The controller (56) can preferably have a frequency, wavelength, or signal command unique to the owner's particular device (10) so that only the owner's controller (56) can open the device (10). In operation, the "open" signal could be triggered by pressing a button once, or alternatively by entering a predetermined custom code by pressing one or more buttons in a sequence. When a valid "open" signal is received by a receiver (e.g. 58) the locking system (50) will immediately unlock and the casings will spring to their open position.

Figure 3:
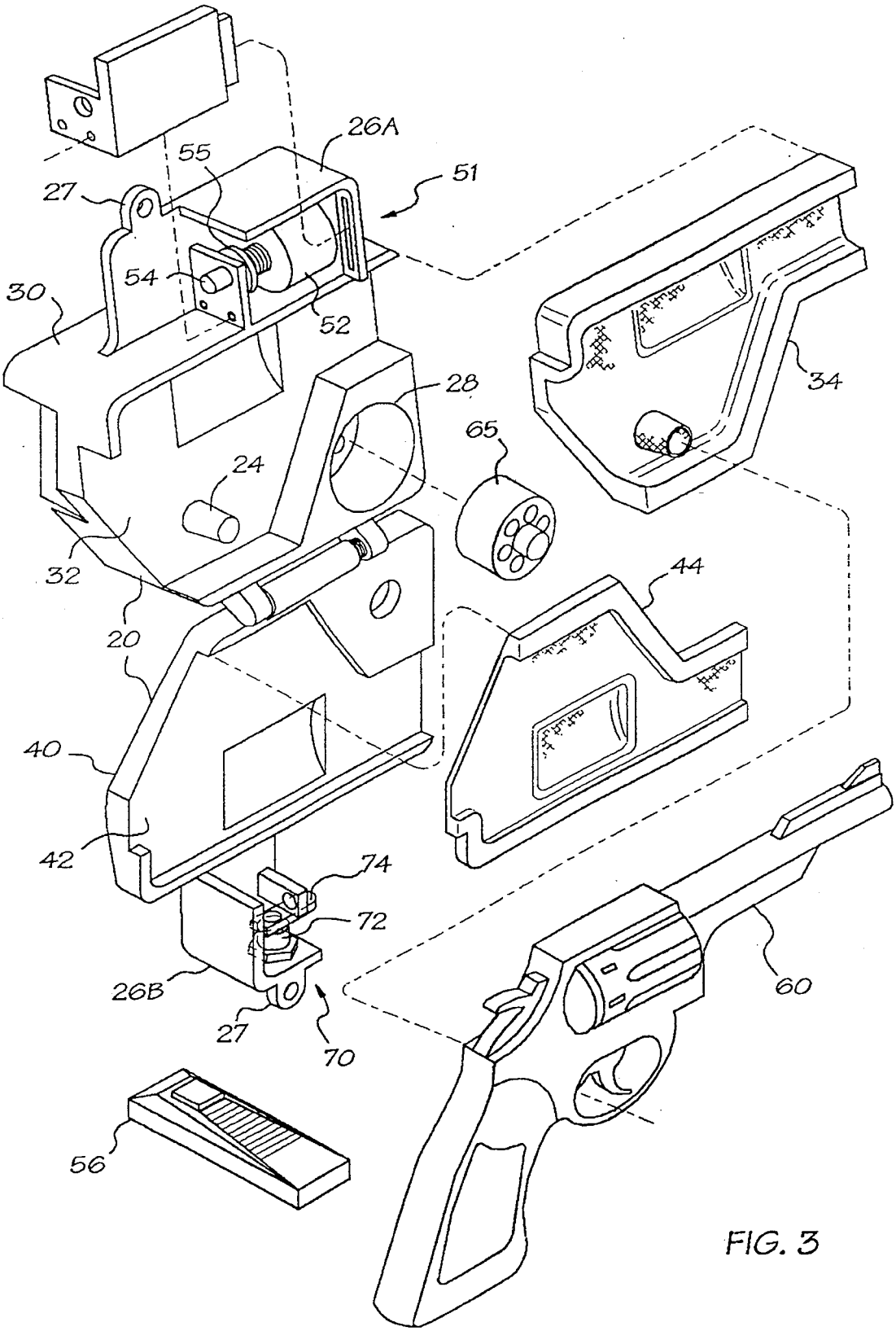
FIG. 3 is an isometric exploded view of the device of FIG. 1, shown in the open position, with an exemplary revolver type firearm and speed loader.

Preferably, the device (10) includes a receptacle (28) in one of the casings (30, 40) for storing ammunition separate from the firearm (60). The ammunition may be stored in a variety of forms, such as loose ammunition, in a speed loader, or in a clip. As best seen in FIG. 3, the receptacle (28) is located within the base casing (30) and stores a speed loader (65).

More decorative alternative embodiments are contemplated which employ cover casings (40) having one or more window portions (not shown) for viewing the firearm, ammunition, or both. Such window material should also be capable of withstanding violent attempts to open the device (10). An appropriate material could be lexan.

To further facilitate security, the device (10) can further comprise a security system (80) or similar means for monitoring and signaling unauthorized attempts to access the firearm (60). As is symbolically depicted in FIG. 6, the security system (80) can preferably be located on the rear face of the device (10) to minimize the possibility of someone tampering with the alarm system (80). For example, one means for detecting unauthorized attempts to approach and/or access the firearm (60) could include a two aligned sensors located on each of the casings (30, 40). If the sensor field is disturbed, whether through an interfering probe or an unauthorized opening of the device (10), the security system (80) will be triggered. As another example, a mercury switch or motion-type detector could be included within the device (10) to detect and trigger the security system (80) in the event of a violent attempt to open the device (10). Whether through a home security system or otherwise, such a security system (80) can include either an audible or silent alarm, and can additionally notify authorities.

For illustration only, the Figures have shown the device (10) holding a revolver type firearm. It is contemplated that the device (10) can be used with all firearms, including but not limited to: semi-automatic handguns, firearms with internal hammers, rifles, and shotguns. When implementing the present invention with larger firearms like rifles and shotguns, one skilled in the art can use two or more devices (10) working independently or in concert (e.g. one might prefer to locate a second support or locking device near the end of the muzzle to prevent tampering). Such an arrangement of multiple devices (10) could be set up to automatically open via a single remote controller (56).

The foregoing description of the preferred embodiments of the invention has been presented for purposes of illustration and description. It is not intended to be exhaustive or to limit the invention to the precise form disclosed. Obvious modifications or variations are possible in light of the above teachings. The embodiments were chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. An apparatus for mounting, displaying, locking, and providing quick access to a firearm having operational portions, comprising:

a) a pair of complementary casings, including:

i. a base casing adapted for mounting onto a structure and for receiving and holding the firearm, and ii. a cover casing adapted for interfacing with the base casing and at least partially covering the firearm;

b) a connection between the cover casing and the base casing such that the casings have a predetermined open position providing substantially unimpeded access to the firearm, and a predetermined closed position whereby the casings prevent access to the operational portions of the firearm;

c) a locking system for locking the casings in the closed position to prevent the unauthorized opening of the casings to the open position, said locking system including a remote unlocking mechanism; and d) a biasing element for automatically opening the casings to the open position when the locking system is unlocked.

2. An apparatus as recited in claim 1, whereby the base casing includes an outwardly and upwardly tapered front portion.

3. An apparatus as recited in claim 1, whereby the base casing includes a resilient material that provides a snug fit for the firearm.

4. An apparatus as recited in claim 1, whereby the connection between the cover casing and the base casing includes a hinge.

5. An apparatus as recited in claim 1, whereby the locking system comprises an electrically actuated lock.

6. An apparatus as recited in claim 1, whereby the locking system includes two or more locks.

7. An apparatus as recited in claim 1, whereby the biasing element comprises a spring for moving the casings to the open position when the locking system is unlocked.

8. An apparatus as recited in claim 1, further comprising at least one stop extending from at least one of the casings adapted to be aligned closely behind one or more of the operational portions of the firearm for preventing unauthorized activation thereof.

9. An apparatus as recited in claim 1, further comprising at least one partially resilient insert for receiving and holding the firearm and selectively accommodating different sizes and types of firearms.

10. An apparatus as recited in claim 1, further comprising a separate ammunition receptacle in at least one of the casings.

11. An apparatus as recited in claim 1, further comprising a security system for detecting unauthorized attempts to access the firearm.

12. An apparatus for mounting, displaying, locking, and providing quick access to a firearm having operational portions, comprising:

a) a pair of complementary casings, including:

i. a base casing adapted for mounting onto a structure and having a outwardly and upwardly tapered front portion to assist in receiving and holding the firearm;

ii. a cover casing adapted for interfacing with the base casing and at least partially covering the firearm;

b) a hinge connecting the cover casing to the base casing such that the casings have a predetermined open position providing substantially unimpeded access to the firearm, and a predetermined closed position whereby the casings prevent access to the operational portions of the firearm;

c) a locking system for locking the casings in the closed position to prevent the unauthorized opening of the casings to the open position; and d) a biasing element for automatically moving the casings to the open position when the locking system is unlocked.

13. An apparatus as recited in claim 12, whereby the locking system includes two or more locks.

14. An apparatus as recited in claim 12, further comprising at least one stop extending from at least one of the casings adapted to be aligned closely behind one or more of the operational portions of the firearm for preventing unauthorized activation thereof.

15. An apparatus as recited in claim 12, further comprising at least one partially resilient insert for receiving and holding the firearm and selectively accommodating different sizes and types of firearms.

16. An apparatus as recited in claim 12, further comprising a separate ammunition receptacle in at least one of the casings.

17. An apparatus as recited in claim 12, further comprising a security system for detecting unauthorized attempts to access the firearm.

18. An apparatus for mounting, displaying, locking, and providing quick access to a firearm having operational portions, comprising:

a) a pair of complementary casings, including:

i. a base casing adapted for mounting onto a structure and having a outwardly and upwardly tapered front portion for receiving and holding the firearm;

ii. a cover casing adapted for interfacing with the base casing and at least partially covering the firearm;

b) a separate ammunition receptacle in at least one of the casings;

c) a hinge connecting the cover casing to the base casing such that the casings have a predetermined open position providing substantially unimpeded access to the firearm, and a predetermined closed position whereby the casings prevent access to the operational portions of the firearm;

d) at least one stop extending from at least one of the casings adapted to be aligned closely behind one or more of the operational portions of the firearm for preventing unauthorized activation thereof;

e) an electrically actuated lock and a means for remotely unlocking the electrically actuated lock for locking the casings in the closed position to prevent the unauthorized opening of the casings to the open position; and f) a biasing means for automatically moving the casings to the open position when the electrically actuated lock is unlocked.

19. An apparatus as recited in claim 5, wherein the remote unlocking mechanism comprises an electronic controller for remotely unlocking the electrically actuated lock.

20. An apparatus for mounting, displaying, locking, and providing quick access to a firearm having operational portions, comprising:

a) a pair of complementary casings, including:

i. a base casing adapted for mounting onto a structure and for receiving and holding the firearm, and ii. a cover casing adapted for interfacing with the base casing and at least partially covering the firearm;

b) a connection between the cover casing and the base casing such that the casings have a predetermined open position providing substantially unimpeded access to the firearm, and a predetermined closed position whereby the casings prevent access to the operational portions of the firearm;

c) a locking system for locking the casings in the closed position to prevent the unauthorized opening of the casings to the open position, said locking system comprising an electrically actuated lock and a remote unlocking mechanism for unlocking the electrically actuated lock; and d) a biasing element for automatically opening the casings to the open position when the locking system is unlocked.

21. An apparatus for mounting, displaying, locking, and providing quick access to a firearm having operational portions, comprising:

a) a pair of complementary casings, including:

i. a base casing adapted for mounting onto a structure and having a outwardly and upwardly tapered front portion to assist in receiving and holding the firearm;

ii. a cover casing adapted for interfacing with the base casing and at least partially covering the firearm;

b) a hinge connecting the cover casing to the base casing such that the casings have a predetermined open position providing substantially unimpeded access to the firearm, and a predetermined closed position whereby the casings prevent access to the operational portions of the firearm;

c) a locking system for locking the casings in the closed position to prevent the unauthorized opening of the casings to the open position, said locking system comprising an electrically actuated lock and a remote unlocking mechanism for unlocking the electrically actuated lock; and d) a biasing element for automatically moving the casings to the open position when the locking system is unlocked.

* * * * *